United States Patent [19]

Ishii et al.

[11] Patent Number: 4,908,659

[45] Date of Patent: Mar. 13, 1990

[54] IMAGE-FORMING MACHINE HAVING A COVER MEMBER AND COMPRISING ENGAGING MEANS AND HAMPERING MEANS FOR CONTROLLING CLOSURE OF THE COVER

[75] Inventors: Yoshifumi Ishii, Neyagawa; Hiroaki Tsuchiya, Nishinomiya, both of Japan

[73] Assignee: Mita Industrial Co., Ltd., Osaka, Japan

[21] Appl. No.: 215,518

[22] Filed: Jul. 6, 1988

[30] Foreign Application Priority Data

Jul. 10, 1987 [JP] Japan ..... 62-170879

[51] Int. Cl.[4] ..... G03G 15/00

[52] U.S. Cl. ..... 355/200; 292/128

[58] Field of Search ..... 355/3 R, 3 DR, 354, 355/133, 200; 292/121, 128, DIG. 1

[56] References Cited

U.S. PATENT DOCUMENTS 4,523,831 6/1985 Yokoo et al. ..... 355/3 R
4,641,947 2/1987 Jishida ..... 355/3 R
4,668,072 5/1987 Yasuda ..... 355/3 R
4,671,644 6/1987 Sumida ..... 355/3 R
4,705,384 11/1987 Mizutani et al. ..... 355/3 R

FOREIGN PATENT DOCUMENTS 0193170 9/1986 .

*Primary Examiner*—Joan H. Pendegrass
*Attorney, Agent, or Firm*—Beveridge, DeGrandi & Weilacher

[57] ABSTRACT

An image-forming machine includes a supporting structure having a lower supporting frame and an upper supporting frame mounted on the lower supporting frame so as to be free to pivot between an open position and a closed position, a locking device for releasably locking the upper supporting frame at the closed position, and a cover member mounted on the supporting structure so as to be opened and closed. The locking device has an engaging member mounted movably between a locking position and a releasing position. The cover member can be maintained in the closed state only when the upper supporting frame is at the closed position and the engaging member is at the locking position.

5 Claims, 4 Drawing Sheets

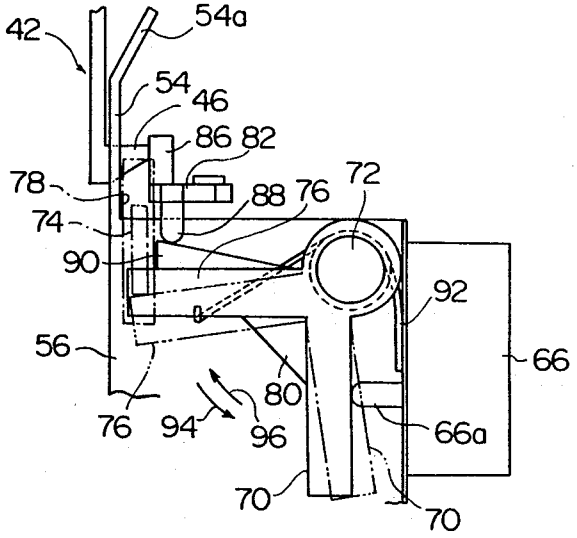
FIG. 3-B
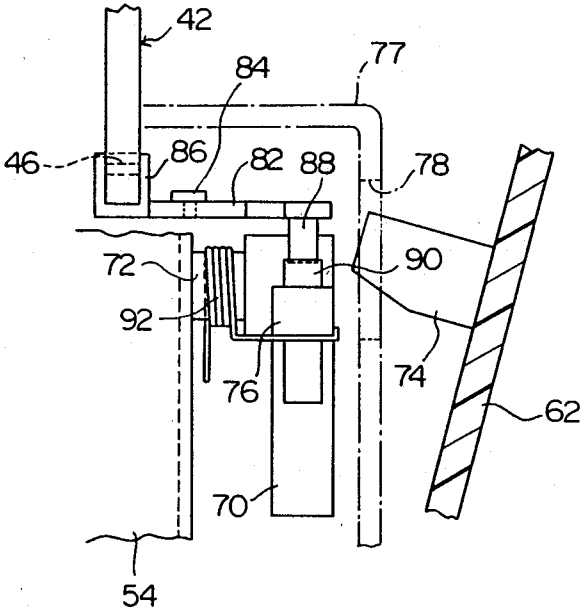
FIG. 3-A

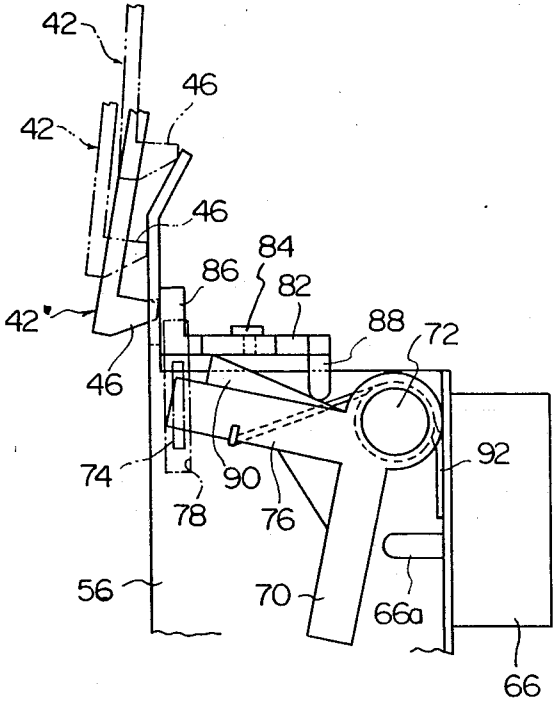
FIG. 4-B
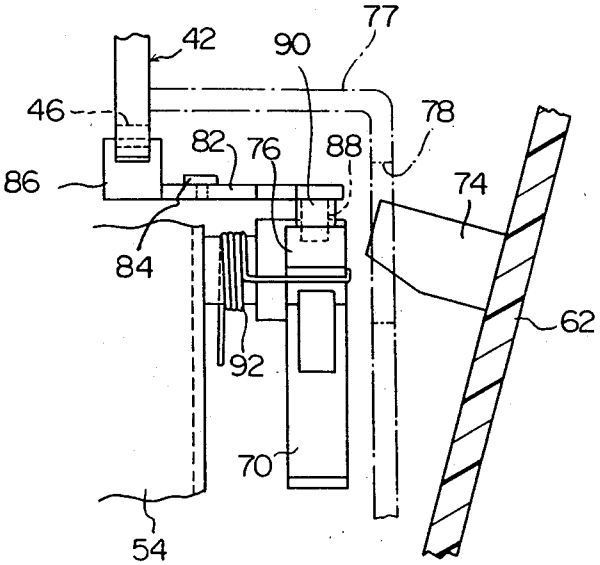
FIG. 4-A

IMAGE-FORMING MACHINE HAVING A COVER MEMBER AND COMPRISING ENGAGING MEANS AND HAMPERING MEANS FOR CONTROLLING CLOSURE OF THE COVER

FIELD OF THE INVENTION

This invention relates to an image-forming machine, more specifically to an image-forming machine provided with a supporting structure comprised of a lower supporting frame and an upper supporting frame mounted on the lower supporting frame so as to be free to pivot between an open position and a closed position.

DESCRIPTION OF THE PRIOR ART

In recent years, an image-forming machine such as an electrostatic copying machine equipped with a supporting structure comprised of a lower supporting frame and an upper supporting frame mounted on the lower supporting frame so as to be free to pivot between an open position and a closed position has gained widespread commercial acceptance. This type of image-forming machine generally includes a front cover member for covering the front surface of the supporting structure. The lower end portion of the front cover member is mounted on the lower supporting frame for free opening and closing, and a detection switch for detecting the closed condition of the front cover member is provided. Most of the conveying passage defined between the lower and upper supporting frames can be opened by opening the front cover member and then opening the upper supporting frame. Consequently, paper jamming which occurs in the conveying passage can be remedied easily. When the front cover member is held in the open position, the detection switch is opened (turned off) to stop supplying current to, for example, a driving source of the image-forming machine. This can prevent the machine from being operated when the upper supporting frame is held at the open position. After paper jamming is remedied, the upper supporting frame is the closed and then the front cover member is closed. As a result, various constituent elements mounted on the upper supporting frame and various constituent elements mounted on the lower supporting frame are maintained in a predetermined positional relation that enables image formation. By holding the front cover member in the closed condition, the detection switch is closed (turned on) to permit current to be supplied to the driving source, etc. of the image-forming machine.

The conventional type image-forming machine, however, has disadvantages on a conventional image-forming machine, an actuating piece for depressing the detection switch and a hampering protrusion for preventing the front cover member from being held in the closed condition when the upper supporting frame is not at the closed position are provided on the inside surface of the front cover member. When the upper supporting frame on which the front cover member is mounted is at the closed position, the hampering protrusion advances into the inside of the cover member through an opening formed in it to allow the front cover member to be held closed. When the upper supporting frame is not at the closed position, the hampering protrusion abuts with part of the front surface of the cover member mounted on the upper supporting frame, and consequently, it is substantially impossible to hold the front cover member in the closed condition. However, even with this arrangement, if the front cover member is pivoted in its closing direction while the upper supporting frame is near the closed position, the hampering protrusion in the front cover member advances into the inside of the cover member through the opening formed in it and it is possible to hold the front cover member closed (in this condition, the detection switch is closed by the action of the actuating piece). If this situation occurs, the image-forming process can be carried out even though the upper supporting frame is not closed. Consequently, the various constituent elements on the upper supporting frame and the various constituent elements on the lower supporting frame are not in their predetermined positional relationship, and a good image cannot be formed. Furthermore, because the upper supporting frame is not held exactly at the closed position, the upper supporting frame is likely to pivot toward its open position due to, for example, vibration which occurs during the image-forming process.

SUMMARY OF THE INVENTION

It is a primary object of this invention to provide an excellent image-forming machine of the above type in which the image-forming process can be hampered accurately when the upper supporting frame is not in its closed position.

According to this invention, there is provided an image-forming machine comprising a supporting structure including a lower supporting frame and an upper supporting frame mounted on the lower supporting frame so as to be free to pivot between an open position and a closed position, locking means for releasably locking the upper supporting frame at the closed position, a cover member mounted on the supporting structure so that it can be opened and closed in order to cover part of the supporting structure, and a detection switch for detecting the closed state of the cover member; in which the locking means has an engaging member mounted for free movement between a locking position and a releasing position, and the cover member is adapted to be held in the closed state only when the upper supporting frame is at the closed position and the engaging member is at the locking position.

BRIEF DESCRIPTION OF THE DRAWINGS

FIGS. 3-A and 3-B are a side sectional view and a front view showing an engaging member of the electrostatic copying machine of FIG. 1 in its locking position; and FIGS. 4-A and 4-B are a side sectional view and a front view showing the engaging member of the electrostatic copying machine of FIG. 1 in a position not fully engaged with an engaging opening.

DETAILED DESCRIPTION OF THE PREFERRED EMBODIMENTS

One specific embodiment of the image-forming machine of the invention will be described in detail with reference to the accompanying drawings.

The following description refers to an electrostatic copying machine as one example of the image-forming machine, but it also applies to other types of image-forming machines, for example a laser beam printer.

Figure 1:
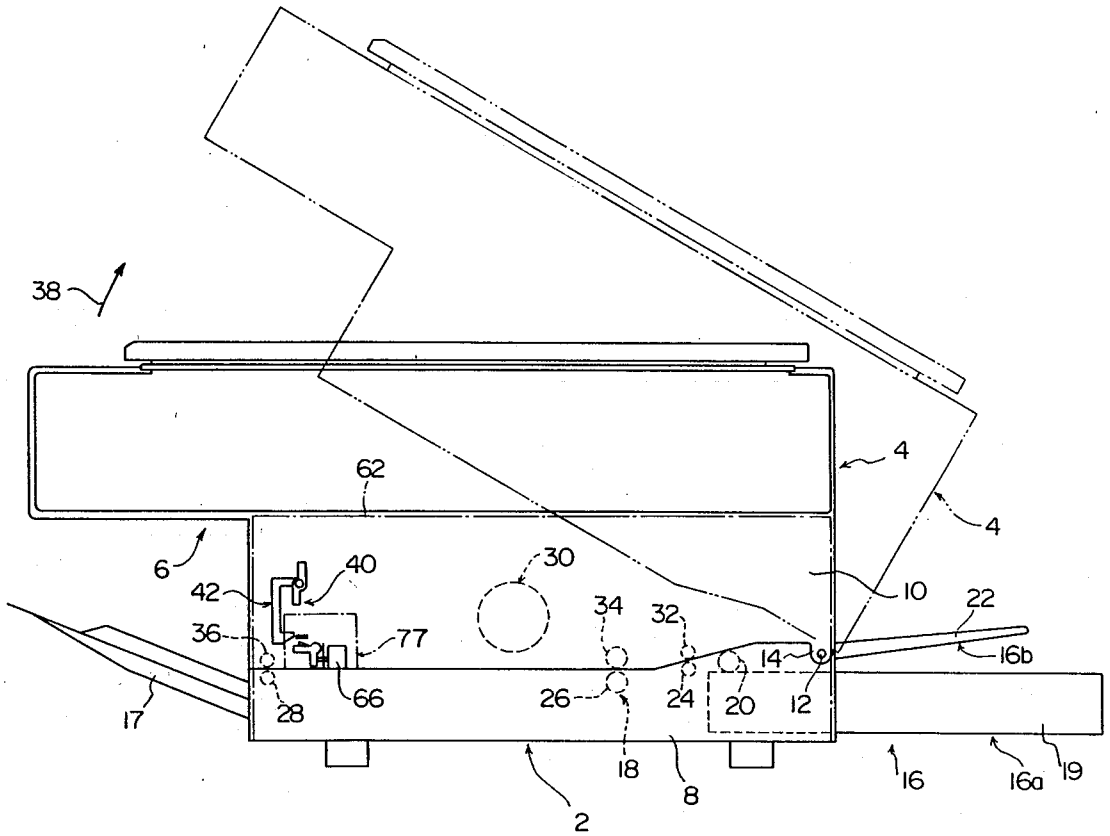
FIG. 1 is a simplified front view, omitting the front cover member, which shows an electrostatic copying machine equipped to provide an image-forming machine according to the present invention.

With reference to FIG. 1, the illustrated electrostatic copying machine is provided with a supporting structure 6 comprised of a lower supporting frame 2 and an upper supporting frame 4 mounted on the lower supporting frame 2. The lower supporting frame 2 has a bottom wall (not shown) and a vertical front base plate 8 and a vertical rear base plate (not shown) extending upwardly from the upper surface of the bottom wall and disposed on the bottom wall in spaced-apart relationship in the front-rear direction (the direction perpendicular to the sheet surface in FIG. 1). The upper supporting frame 4 has a vertical front base plate 10 and a vertical rear base plate (not shown) disposed in spaced-apart relationship in the front-rear direction corresponding to the vertical front base plate 8 and the vertical rear base plate of the lower supporting frame 2. In the embodiment, the right end portion of the lower supporting frame 2 is pivotally linked to the right end portion of the upper supporting frame 4 via a supporting shaft 12. Specifically, downwardly projecting portions 14 (only one of which is shown in FIG. 1) are formed integrally in the vertical front base plate 10 and the vertical rear base plate of the upper supporting frame 4, and the supporting shaft 12 is mounted through the projecting portions 14 and the right upper end portions of the vertical front base plate 8 and the vertical rear base plate of the lower supporting frame 2. Hence, the upper supporting frame 4 is free to pivot between a closed position shown by a solid line in FIG. 1 and an open position shown by a two-dot chain line in FIG. 1 about the supporting shaft 12 as a center.

In the illustrated embodiment, copying paper feed means 16, transfer means (not shown), a fixing device (not shown), a receiving tray 17, and the lower elements of a paper conveying mechanism 18 are mounted on the lower supporting frame 2 (between the vertical front base plate 8 and the vertical rear base plate). The paper feed means 16 is provided with a first feed means **16*a* of the cassette paper feeding type and a second feed means 16*b* of the manual paper feeding type, and the first feed means 16*a* includes a copying paper cassette 19 mounted detachably on a cassette-receiving section defined in the supporting structure and a delivery roller 20 disposed above the cassette-receiving section for delivering a copying paper from the paper cassette 19. The second feed means 16*b* has a paper feed table 22 on which a copying paper is positioned. The lower elements of the paper conveying mechanism 18 include conveying rollers 24 and 26 and a discharge roller 28**.

A rotating drum 30 having a photosensitive material disposed on its peripheral surface, charging means (not shown), a developing device (not shown), a cleaning device (not shown) and an optical device (not shown), and the upper elements of the paper conveying mechanism 18 are mounted on the upper supporting frame 4 (between the vertical front base plate 10 and the vertical rear base plate). The other elements of the paper conveying mechanism 18 include conveying rollers 32 and 34 and a discharge roller 36 cooperating respectively with the rollers 24, 26 and 28.

Thus, when the upper supporting frame 4 is at the closed position, the various constituent elements (the paper feed means 16, etc.) mounted on the lower supporting frame 2 and the various constituent elements (the rotating drum 30, etc.) mounted on the upper supporting frame 4 are held in the positional relation shown in FIG. 1. The upper elements of the paper conveying mechanism 18 and the lower elements thereof cooperate with each other to define a copying paper conveying passage between the lower supporting frame 2 and the upper supporting frame 4, and a paper fed from the paper feed means 16 (the first feed means **16*a* or the second feed means 16*b*) is conveyed through this paper conveying passage. An image is formed on it during conveying, and the image-bearing paper is finally discharged into the receiving tray 17. On the other hand, when the upper supporting frame 4 is pivoted in the direction shown by an arrow 38 and held at the open position, the space between the lower supporting frame 2 and the upper supporting frame 4, namely between the upper and lower elements of the paper feed mechanism 18, is opened. Consequently, as can be seen from FIG. 1**, if the copying paper jams up in the paper conveying passage, it can be easily removed from this open space.

Figure 2:
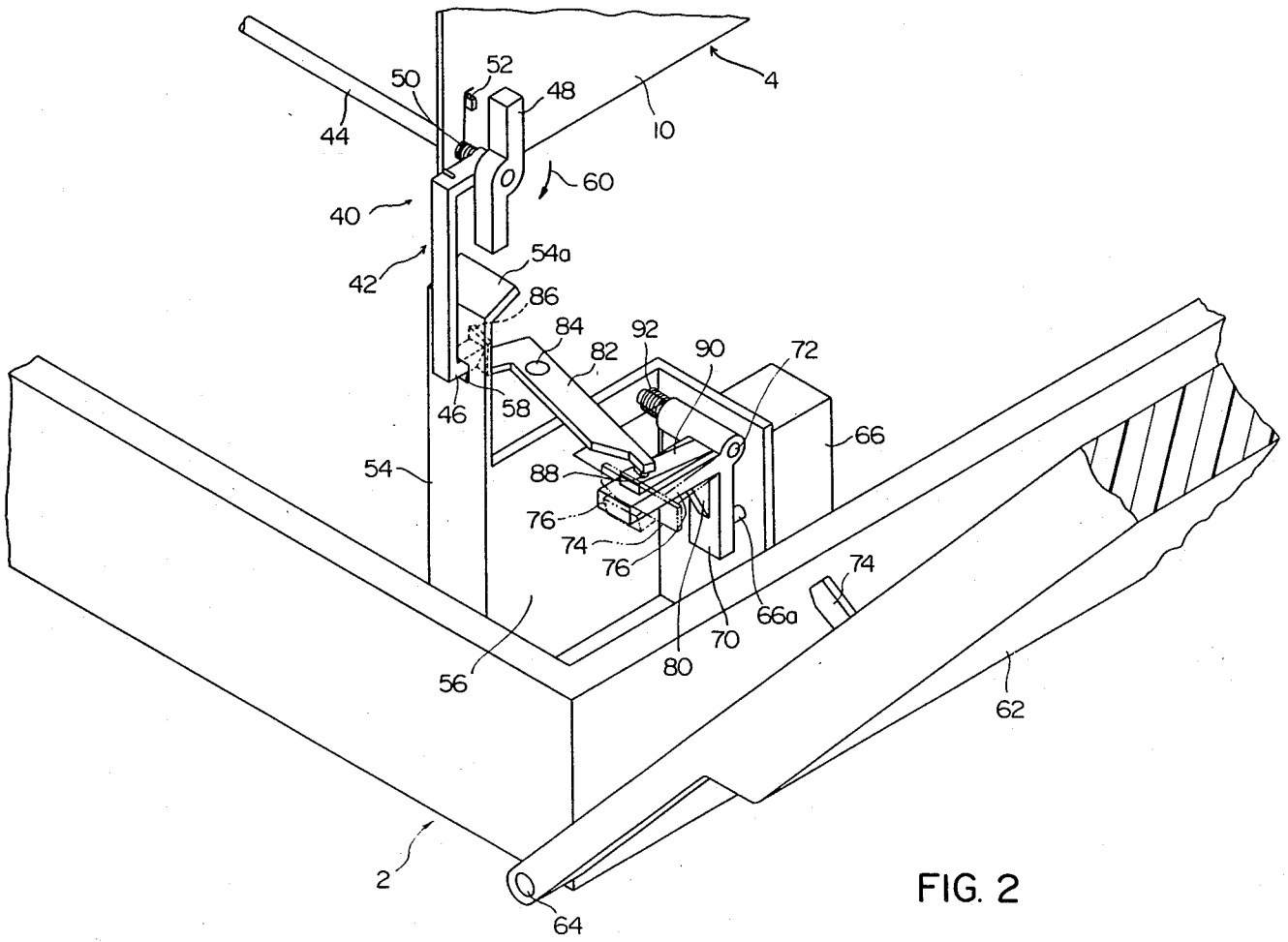
FIG. 2 is a partial perspective view depicting the front cover member for the electrostatic copying machine of FIG. 1 in a slightly opened position.

With reference to FIGS. 1 and 2, the illustrated electrostatic copying machine is provided with locking means 40 for locking the upper supporting frame 4 releasably in the closed position. The locking means 40 has an engaging member 42. A shaft member 44 is mounted between the vertical front base plate 10 and the vertical rear base plate (not shown) of the upper supporting frame 4, and the engaging member 42 is rotatably mounted on a projecting end portion of the shaft member 44 which projects forwardly from the vertical front base plate 10. An engaging claw 46 is provided at one end portion of the engaging member 42, and an operating portion 48 is provided at its other end portion; they are formed of a synthetic resin as a one-piece unit. The engaging member 42 is free to pivot between a releasing position shown by a two-dot chain line in FIG. 4-B and a locking position shown in FIG. 3-B (also shown in FIG. 2), as can be seen from FIGS. 3-B and 4-B.

In the illustrated embodiment, biasing means is annexed to the engaging member 42. The biasing means is comprised of a torsion coil spring 50 fitted over the projecting end portion of the shaft member 44. One end portion of the torsion coil spring 50 engages an engaging protrusion 52 formed in the front surface of the vertical front base plate 10 of the upper supporting frame 4, and its other end portion engages the engaging member 42. The torsion coil spring 50 is elastically biased counterclockwise when viewed from right bottom in FIG. 2. Preferably, a hampering piece (not shown) is provided for hampering the pivoting movement of the engaging member 42 beyond the locking position. By so doing, the engaging member 42 is held in the locking position by the action of the hampering piece even when the upper supporting frame 4 is brought to the open position. Accordingly, when the upper supporting frame 4 is to be held at the closed position, the engaging member 42 is exactly held at the releasing position by the action of an actuating plate to be described.

An actuating plate 54 is provided in the lower supporting frame 2 in correspondence to the engaging member 42 provided in the upper supporting frame 4. In the illustrated embodiment, the actuating plate 54 is formed as an integral unit with a supporting plate 56, and these plates 54 and 56 are fixed to the upper surface of the bottom wall of the lower supporting frame 2. The actuating plate 54 extends substantially vertically and upwardly, and its upper end portion extends upwardly while being inclined slightly inwardly (to the right in FIG. 2). A rectangular opening 58 is formed in the actuating plate 54 at a site slightly below the inclined portion 54*a*.

Because of this arrangement, the engaging member 42 can be held at the releasing position by operating the operating portion 48 and pivoting the engaging member 42 in the direction shown by an arrow 60. At the releasing position, the engaging claw 46 of the engaging member 42 is detached from the engaging opening 58 of the actuating plate 54, and as a result, the upper supporting frame 4 can be pivoted in the direction shown by arrow 38 (FIG. 1) to the open position. On the other hand, when the upper supporting frame 4 is pivoted from the open position toward the closed position, the upper surface of the inclined portion 54*a* of the actuating plate 54 acts on the engaging claw 46 of the engaging member 42, and the pivoting of the upper supporting frame 4 toward the closed position pivots the engaging member 42 in the direction of arrow 60. Near the closed position (where the substantially vertically extending part of the actuating plate 54 acts on the engaging claw 46), the engaging member 42 is held at the releasing position. When the upper supporting frame 4 has thus been pivoted to the closed position, the engaging claw 46 of the engaging member 42 is positioned in the engaging opening 58 of the actuating plate 54, and by the action of the torsion coil spring 50, the engaging member 42 is pivoted to the locking position from the releasing position. Consequently, the engaging claw 46 comes into engagement with the opening 58 to lock the upper supporting frame 4 releasably into the closed position.

In the illustrated embodiment, a front cover member 62 is provided for covering the front surface of the supporting structure 6, more specifically, substantially the entire front surface of the lower supporting frame 2 and the lower part of the front surface of the upper supporting frame 4. The front cover member 62 can be formed, for example, from a synthetic resin. In the illustrated embodiment, the lower end portions of both of its sides are mounted pivotally on the lower supporting frame 2 via pins 64 (only one of which are shown in FIG. 2). The front cover member 62 is free to pivot between a first position at which it covers the front surface of the supporting structure 6 (the position shown by a one-dot chain line in FIG. 1) and a second position at which it opens the front surface of the supporting structure 6 (in the open state, the cover member 62 extends forwardly substantially in a horizontal fashion) about the pin 64 as a center.

The illustrated electrostatic copying machine is further provided with a detection switch 66 for safety. The detection switch 66 is mounted on the supporting plate 56, and its detecting portion 66*a* projects to the left in FIG. 2 through a hole formed in the supporting plate 56. The detection switch 66 is adapted to be closed (on) when the front cover member 62 is in the closed state, but to be opened (off) when the front cover member 62 is in the open state. A press member 70 acting on the detecting portion 66*a* of the detection switch 66 is mounted on the supporting plate 56. The press member 70 is rotatably mounted on a short rod 72 implanted in the supporting plate 56, and is free to pivot between the position shown in FIG. 4-B (at which it moves away from the detecting portion 66*a* of the detection switch 66) and the position shown by a two-dot chain line in FIG. 3-B (at which it depresses the detecting portion 66*a* to close the detection switch 66).

In the illustrated embodiment, an actuating protrusion 74 for actuating the press member 70 is provided integrally in the inside surface of the cover member 62. With regard to the actuating protrusion 74, a hampering member 76 (constituting hampering means) is disposed, and the hampering member 76 is formed integrally with the press member 70. The actuating protrusion 74 projects inwardly from the inside surface of the front cover member 62. The actuating protrusion 74 can advance into a cover 77 for covering the detection switch 66, the press member 70, etc. (FIGS. 1, 3-A and 4-A) through an opening 78 (FIGS. 3-A and 4-A) formed in the cover 77. The hampering member 76 extends nearly horizontally from a base portion of the press member 70 extending downwardly, and a reinforcing portion 80 is formed between the hampering member 76 and the press member 70. An intermediate lever 82 is interposed between the hampering member 76 and the engaging member 42. The intermediate lever 82 is nearly L-shaped and is pivotally mounted via a short rod 84. One end portion of the intermediate lever 82 extends toward the engaging opening 58 formed in the actuating plate 54 and its other end portion, toward the free end portion of the hampering member 76. An upwardly extending abutting portion 86 is formed in one end portion of the intermediate lever 82, and a downwardly extending actuating protrusion 88 is provided on the under surface of its other end portion. An inclined protrusion 90 is further provided in the upper surface of the hampering member 76. The upper inclined surface of the inclined protrusion 90 is inclined upwardly toward the free end portion of the hampering member 76. The actuating protrusion 88 of the intermediate lever 82 is designed to act on this upper inclined surface. Biasing means is annexed to the hampering member 76. The illustrated biasing means is comprised of a torsion coil spring 92 fitted over the short rod 72. Its one end portion is engaged with the hampering member 76, and its other end portion, with the supporting plate 56 (see FIGS. 3-A and 4-A also). The torsion coil spring 92 elastically biases the hampering member 76 (and the press member 70 as a unit) clockwise when viewed from right bottom in FIG. 2, whereby the inclined upper surface of the inclined protrusion 90 abuts against the actuating protrusion 88 of the intermediate lever 82.

Because of the above arrangement, when the engaging member 42 is at the releasing position, the press member 70 and the hampering member 76 are biased clockwise in FIG. 4-B about the short rod 72 (an axis extending in the front-rear direction) as a center by the action of torsion coil spring 92, and furthermore, the intermediate lever 82 is biased counterclockwise when viewed from above in FIGS. 4-A and 4-B about the short rod 84 (an axis extending vertically) as the center by the action of the inclined protrusion 90 of the hampering member 76. The intermediate lever 82 is held at a first angular position (the position shown in FIGS. 4-A and 4-B) when its abutting portion 86 abuts with the inner surface of the actuating plate 54, and the abutting portion 86 closes the engaging opening 58 of the actuating plate 54. Furthermore, when the actuating protrusion 88 of the intermediate lever 82 is positioned at the base portion of the hampering member 76 (the right end portion of the inclined protrusion 90 in FIGS. 2 and 4), the hampering member 76 is held at the operating position shown in FIGS. 4-A and 4-B. When the hampering member 76 is at the operating position, the press member 70 moves away from the detecting portion 66*a* of the detection switch 66 and the detection switch 66 is opened (off), as is clearly shown in FIG. 4-B. On the other hand, when the engaging member 42 is brought to the locking position from the releasing position, its engaging claw 46 acts on the abutting portion 86 of the intermediate lever 82 to pivot the intermediate lever 82 clockwise when viewed from above in FIGS. 3-A and 3-B. As a result, the actuating protrusion 88 of the intermediate lever 82 moves toward the free end portion on the upper surface of the inclined protrusion 90 provided in the hampering member 76 and the intermediate lever 82 is held at its second angular position shown in FIGS. 3-A and 3-B. Furthermore, by the movement of the actuating protrusion 88 on the inclined protrusion 90, the hampering member 76 is pivoted in the direction shown by an arrow 94 (FIG. 3-B), and held at its non-operating position shown by a solid line in FIG. 3-B and also shown in FIG. 3-A. As shown in FIG. 3-B, when the hampering member 76 is at the non-operating position, the press member 70 abuts with the detecting portion 66*a* of the detection switch 66 but does not depress the detecting portion 66*a*. Thus, at this time too, the detection switch 66 is maintained open (off). The hampering members 76 and the press member 70 can pivot in the direction shown by arrow 94 in FIG. 3-B, and by this pivoting in the direction of arrow 94, the press member 70 depresses the detecting portion 66*a* of the detection switch 66 to close (turn on) the switch 66.

The operation and effect of the electrostatic copying machine of the above-described structure will now be described.

To bring the upper supporting frame 4 to the open position, the operator pivots the front cover member 62 toward himself, releases the locking of the locking means 40, and pivots it in the direction of arrow 38 (FIG. 1). When the front cover member 62 is held in the open state, the actuating protrusion 74 provided on its inside surface moves away from the hampering member 76 as shown in FIG. 2, and the hampering member 76 and the press member 70 are pivoted in the direction of arrow 96 from the positions shown by two-dot chain line in FIG. 3-B and held at the positions shown by solid lines in FIG. 3-B (the pivoting of these members beyond the above positions is hampered by the abutting of the inclined protrusion 90 of the hampering member 76 with the actuating protrusion 88 of the intermediate lever 82). As a result, the depression of the detecting portion 66*a* of the detection switch 66 by the press member 70 is released and the detection switch 66 is opened (off).

Then, the operating portion 48 of the engaging member 42 is operated to bring it to the releasing position from the locking position. As a result, the engaging claw 46 of the engaging member 42 comes out of engagement with the engaging opening 58 of the actuating plate 54. As can be understood from FIGS. 4-A and 4-B, the engaging claw 46 of the engaging member 42 moves away from the abutting portion 86 of the intermediate lever 82, and by the action of the torsion coil spring 92, the hampering member 76 and the press member 70 are held at the positions shown in FIGS. 4-A and 4-B. The intermediate lever 82 is held at the first angular position (by the abutting of the abutting portion 86 of the intermediate lever 82 with the inside surface of the actuating plate 54, the pivoting of the intermediate lever 82 beyond the first angular position and the pivoting of the hampering member 76 and the press member 70 beyond the above positions are hampered). When the hampering member 76 is at the operating position shown in FIG. 4-B, it is in the moving path of the actuating protrusion 74 of the front cover member 62 to hamper the pivoting of the front cover member 62 toward the first position. Hence, it is substantially impossible to maintain the front cover member 62 in the closed position. Specifically, when the front cover member 62 is pivoted toward the first position as shown in FIG. 4-A while the hampering member 76 is at the hampering position, the actuating protrusion 74 of the front cover member 62 abuts with one end surface (the right end surface in FIG. 4-A) of the hampering member 76 as shown by a one-dot chain line in FIG. 4. At this time, the hampering member 76 is free to pivot about an axis extending in the front-rear direction (short rod 72), but is unable to pivot in a direction substantially perpendicular to this axis. Accordingly, when the actuating protrusion 74 acts on one end surface of the hampering member 76 in a direction perpendicular to the pivoting direction, the aforesaid pivoting of the front cover member 62 is hampered, and it is substantially impossible to maintain the front cover member 62 in the closed state (and therefore, the detection switch 66 is not closed).

Thereafter, the upper supporting frame 4 is pivoted in the direction of arrow 38 to open the copying paper conveying passage. In the event of paper jamming in the paper conveying passage, the paper can be easily taken out from it.

To make the machine ready for copying, the upper supporting frame 4 is held at the closed position and then the front cover member 62 is maintained in the closed state. When the upper supporting frame 4 is pivoted toward the closed position in a direction opposite to the direction of arrow 38 (FIG. 1), the engaging member 42 is held in the releasing position by the action of the actuating plate 54 of the lower supporting frame 2. When the upper supporting frame 4 is pivoted to the closed position, the engaging claw 46 of the engaging member 42 is positioned in the engaging opening 58 of the actuating plate 54, and the engaging member 42 is pivoted from the releasing position to the locking position by the action of the torsion coil spring 50. As a result, the upper supporting frame 4 is releasably locked at the above closed position. When the engaging member 42 is held at the locking position, the engaging claw 46 of the engaging member 42 projects inwardly through the opening 58 of the actuating plate 54 and acts on the abutting portion 86 of the intermediate lever 82. As a result, the hampering member 76 and the press member 70 are pivoted in the direction of arrow 94 (FIG. 3-B) via the intermediate lever 82, as shown in FIGS. 3-A and 3-B, and held at the positions shown in FIG. 3-A and by solid lines in FIG. 3-B. Consequently, the hampering member 76 moves slightly downwardly and is held at the non-operative position to permit pivoting of the front cover member 62. In the illustrated embodiment, when the upper supporting frame 4 is near the closed position, the engaging member 42 is held at the releasing position by the action of the actuating plate 54 as shown by a two-dot chain line in FIG. 4-B. Accordingly, the hampering member 76 is held at the hampering position and it is substantially impossible to maintain the front cover member 62 in the closed state. In addition, when the engagement between the engaging claw 46 of the engaging member 42 and the engaging opening 58 of the actuating plate 54 is substantially incomplete, the intermediate lever 82 is hardly turned, and the hampering member 75 is approximately at the operating position, as shown by a solid line in FIG. 4-B. Accordingly, even when the front cover member 62 is pivoted toward the first position in this state, the actuating protrusion 74 abuts with one end surface of the hampering member 76, and it is substantially impossible to maintain the front cover member 62 in the closed state.

Thereafter, the front cover member 62 is pivoted toward the first position and maintained in the closed state. As a result, since the hampering member 76 is at the non-operating position, the actuating protrusion 74 of the front cover member 62 acts on the free end portion of the hampering member 76 from above through the opening 78 of the cover 77 to pivot the hampering member 76 and the press member 70 further to the position shown by a two-dot chain line in FIG. 3-B in the direction shown by arrow 94. Thus, the press member 70 depresses the detecting portion 66*a* of the switch 66 and the detection switch 66 is closed. In the illustrated embodiment, when the detection switch 66 is opened, the supply of current to a main driving source, etc. of the electrostatic copying machine is stopped, and the copying process is not carried out even when a main switch and a copying start switch (not shown) are closed. The copying process becomes possible when the detection switch 66 is closed in the manner described above.

Because of the above structure and operation, the hampering member 76 can be held at the non-operating position thereby permitting the front cover member 62 to be in the closed state only when the upper supporting frame 4 is at the closed position and the engaging member 42 is at the locking position. When the upper supporting frame 4 is not at the closed position or the engaging member 42 is not at the locking position (namely when the engaging claw 46 of the engaging member 42 does not sufficiently engage the engaging opening 58 of the actuating plate 54), it is substantially impossible to maintain the front cover member 62 in the closed state, and the performance of the copying process can be hampered exactly.

While the present invention has been described hereinabove with reference to one specific embodiment of the electrostatic copying machine of the invention as one example of the image-forming machine, it should be understood that the invention is not limited to this specific example, and various changes and modifications are possible without departing from the scope of the invention described and claimed herein.

In the illustrated embodiment, the intermediate lever 82 is disposed between the engaging member 42 and the hampering member 76. It is possible, if desired, to omit the intermediate lever 82 and design the engaging member 42 so as to act directly on the hampering member 76.

In the illustrated embodiment, the hampering member 76 and the press member 70 are formed as a one-piece unit, but they may be formed as separate members. In this case, the hampering member 76 may be mounted pivotally between the operating position and the non-operating position and held at the non-operating position when the engaging member 42 is at the locking position, and at the operating position when the engaging member 42 is at the releasing position. The press member 70 may be mounted pivotally between the pressing position at which it depresses the detecting portion 66*a* of the detection switch 66 and the non-operating position at which it does not substantially act on the detecting portion 66*a*, and held at the non-operating position when the front cover member 62 is in the open state, and at the pressing position by the action of the actuating protrusion 74 when the front cover member 62 is maintained in the closed state.

In the illustrated embodiment, the present invention is applied to the front cover member 62 covering the front surface of the supporting structure 6 but the invention can equally be applied to another cover member.

We claim:

1. An image forming machine comprising a supporting structure including a lower supporting frame, an upper supporting frame mounted on the lower supporting frame so as to be free to pivot between an open position and a closed position, locking means for releasably locking the upper supporting frame at the closed position, a cover member mounted on the supporting structure so that it can be opened and closed in order to cover part of the supporting structure, and a detection switch for detecting the closed state of the cover member; in which the locking means has an engaging member mounted for pivotal movement between a locking position and a releasing position, the cover member is adapted to be held closed only when the upper supporting frame is at the closed position and the engaging member is at the locking position an inwardly-projecting, actuating protrusion is provided in the cover member to move along a path of movement as the cover member is closed, hampering means is provided in the supporting structure to have a pivotably mounted hampering member and means for pivotably moving the hampering member from a non-operating position to a position within the path of movement of the protrusion, when the engaging member is at the locking position, the hampering member is held at its non-operating position by the engaging member so as to permit the cover member to be held closed, and when the engaging member is pivoted from the locking position toward the releasing position, the moving means pivotably moves the hampering member from its non-operating position into the path of movement of the actuating protrusion, incident to the pivoting movement of the engaging member, so that the actuating protrusion abuts with the hampering member and the cover member is thereby kept from being closed.

2. The image-forming machine of claim 1 in which the engaging member is mounted pivotally on the upper supporting frame, an engaging claw is provided at one end portion of the engaging member, an actuating plate is provided on the lower supporting frame, and an engaging opening with which the engaging claw can be engaged is formed in the actuating plate, when the upper supporting frame is pivoted toward the closed position, the actuating plate acts on the engaging claw of the engaging member near the closed position to hold the engaging member at the releasing position, and when the upper supporting frame is pivoted to the closed position, the engaging claw is positioned in the engaging opening, and thus, by the pivoting of the engaging member to the locking position from the releasing position, the engaging claw is engaged releasably with the engaging opening.

3. The image-forming machine of claim 1 in which the hampering member is formed as an integral unit with a press member for depressing the detecting portion of the detection switch, when the hampering member is at its non-operating position, the actuating protrusion of the cover member acts on the hampering member in the pivoting direction of the hampering member and pivots the hampering member and the press member, whereby the cover member can be closed, and when the hampering member is positioned in the path of movement of the actuating protrusion, the actuating protrusion acts on the hampering member in a direction substantially perpendicular to the pivoting direction of the hampering member.

4. The image-forming machine of claim 1 which further comprises biasing means for biasing the engaging member toward the locking position.

5. The image-forming machine of claim 1 in which the cover member covers the front surface of the supporting structure.

* * * * *